US005080227A

United States Patent [19]

Focke

[11] Patent Number: 5,080,227

[45] Date of Patent: Jan. 14, 1992

[54] PACK MADE OF THIN CARDBOARD, ESPECIALLY FOR CIGARETTES

[75] Inventor: Heinz Focke, Verden, Fed. Rep. of Germany

[73] Assignee: Focke & Co., (GmbH & Co.), Verden, Fed. Rep. of Germany

[21] Appl. No.: 592,751

[22] Filed: Oct. 4, 1990

[30] Foreign Application Priority Data

Oct. 6, 1989 [DE] Fed. Rep. of Germany ..... 3933455

[51] Int. Cl.[5] ..... B65D 5/38; B65D 85/10

[52] U.S. Cl. ..... 206/273; 206/815; 206/817

[58] Field of Search ..... 206/271, 273, 815, 817; 229/19, 20, 11, 9

[56] References Cited

U.S. PATENT DOCUMENTS

| | | | |
|---|---|---|---|
| 2,354,239 | 7/1944 | Williamson | 206/273 X |
| 3,749,234 | 7/1973 | Gero | 206/273 X |
| 3,818,676 | 6/1974 | Russell et al. | 53/169 |
| 3,877,573 | 4/1975 | Scott et al. | 206/273 X |
| 3,881,599 | 5/1975 | Flaherty | 206/273 |
| 4,303,155 | 12/1981 | Focke et al. | 206/273 X |
| 4,534,463 | 8/1985 | Bouchard | 206/273 X |
| 4,646,960 | 3/1987 | Challand | 206/273 X |
| 4,685,275 | 8/1987 | Nigrelli | 53/458 |
| 4,779,923 | 10/1988 | Focke et al. | 206/273 |

FOREIGN PATENT DOCUMENTS

| | | |
|---|---|---|
| 2849786 | 5/1980 | Fed. Rep. of Germany . |
| 8104045 | 8/1981 | Fed. Rep. of Germany . |
| 2150119 | 6/1985 | United Kingdom . |

*Primary Examiner*—Paul T. Sewell
*Assistant Examiner*—Jacob K. Ackun, Jr.
*Attorney, Agent, or Firm*—Sughrue, Mion, Zinn, Macpeak & Seas

[57] ABSTRACT

Pack made of thin cardboard, especially for cigarettes. In slide packs, a cigarette group (11) enwrapped by an inner wrapping (12) is located within a box part (17) being open at the top. This box part (17) is slideably arranged in a casing (18) open on one side (push-out opening 29). An oppositely situated side wall (30) is closed except for an actuating opening (41). For mechanically producing such packs, the casing (18) is designed such that in an intermediate folding position it can be folded down flat. In this intermediate folding position, side tabs (39, 40) for forming the side wall (30) of the casing (18) extend in the plane of front wall (32) and rear wall (33).

6 Claims, 7 Drawing Sheets

PACK MADE OF THIN CARDBOARD, ESPECIALLY FOR CIGARETTES

BACKGROUND OF THE INVENTION

The invention relates to a cuboidal pack made of (thin) cardboard, especially for cigarettes, consisting of an (inner) box part and a cup-like casing surrounding said box part in closed postion, said casing having a push-out opening and a side wall situated opposite thereof, the box part and the casing being sliedeable relative to one another.

Packs of this type are known in the art, their advantage being that they can be operated with one hand. To take out a cigarettes, the box part is partially pushed out of the casing via an actuating opening formed in the side wall of the casing. Expediently, the pack is provided with a mechanical lock, preventing the box part from being completely pushed out of the casing.

The specific design of such packs makes them more difficult to be produced on high-performance packaging machines. Handling the casing is particularly difficult, since it has to be folded from a complex blank and then united with the box part.

SUMMARY OF THE INVENTION

It is the object of the invention to design the aforedescribed pack such that it can be produced on high-performance packaging machines without any difficulties.

In order to attain this object the pack is characterized in that in an intermediate folding position, the casing is flatly foldable and erectable therefrom to a three-dimensional form from which it can be finally folded.

The basic concept of the invention is to form an intermediate product from the casing, which can be folded down flat because of its appropriate design. This substantially facilitates the handling of the casing within the packaging machine. The flat-folded casing can also be stacked. In further operating steps, the casing is erected to a three-dimensional form and is then ready-folded and united with the box part by pushing the two parts together.

The casing as taught by the invention is designed such that the side wall opposing the push-out opening consists of side tabs which in the intermediate folding position extend in the plane of the front and rear wall of the casing. Thus, the casing can be folded down flat. After the casing a has been erected, the side tabs are folded into the folding position and connected to one another to form the side wall.

Another novel feature of the pack as taught by the invention relates to an inner wrapping for the cigarettes or cigarette group. Preferably, the inner wrapping is made of tin foil. According to the invention, the inner wrapping is provided with a tear-off flap defined by weakening lines, especially by perforation lines in the upper region being exposed when the pack is opened. This tear-off flap has the form of a cap extending across a corner of the cigarette group. A corner or edge portion of the cigarette group is exposed by pulling off the tear-off flap, so that the cigarettes can be easily extracted.

SUMMARY OF THE INVENTION

Further features relate to the design of the casing and the inner wrapping. An exemplary embodiment is described in a more detail below with reference to the drawings, in which:

FIG. 1 is a perspective view of a pack in open position, made of box part and casing, FIG. 2 is a schematic horizontal sectional view of the pack as shown in FIG. 1, FIG. 3 is a horizontal sectional view corresponding to FIG. 2, but with the pack being closed, FIG. 4 is a horizontal sectional view of an enlarged de tail of the pack in open position, namely stop and counter stop, FIG. 5 is a perspective view of the (outer) casing in an intermediate folding position, FIG. 6 shows a folded out blank for the casing, FIG. 7 shows the blank for the box part, also folded out, FIG. 8 is a perspective view of the block-shaped pack contents (cigarette group) with inner wrapping, FIG. 9 shows a folded out blank for an inner wrapping as shown in FIG. 8.

DESCRIPTION OF A PREFERRED EMBODIMENT

Figure 1:
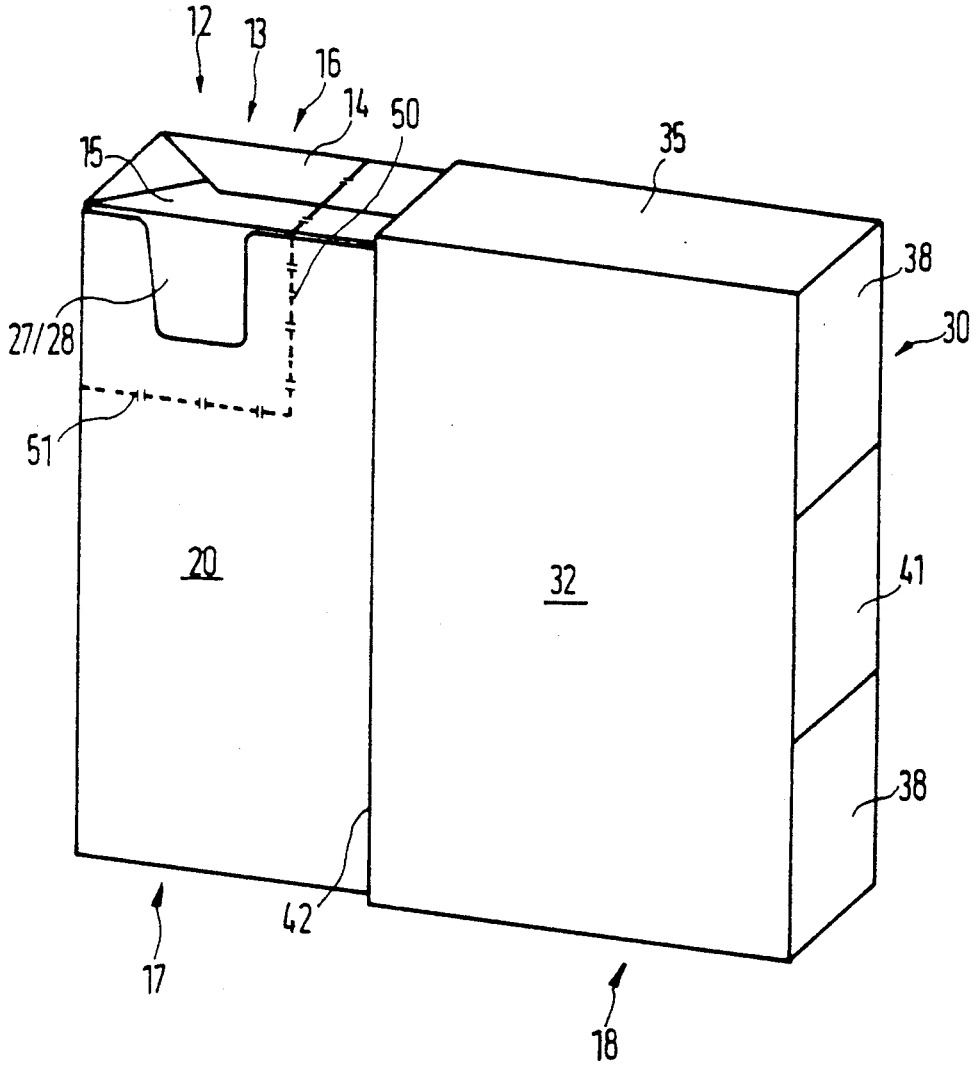
Figure 2:
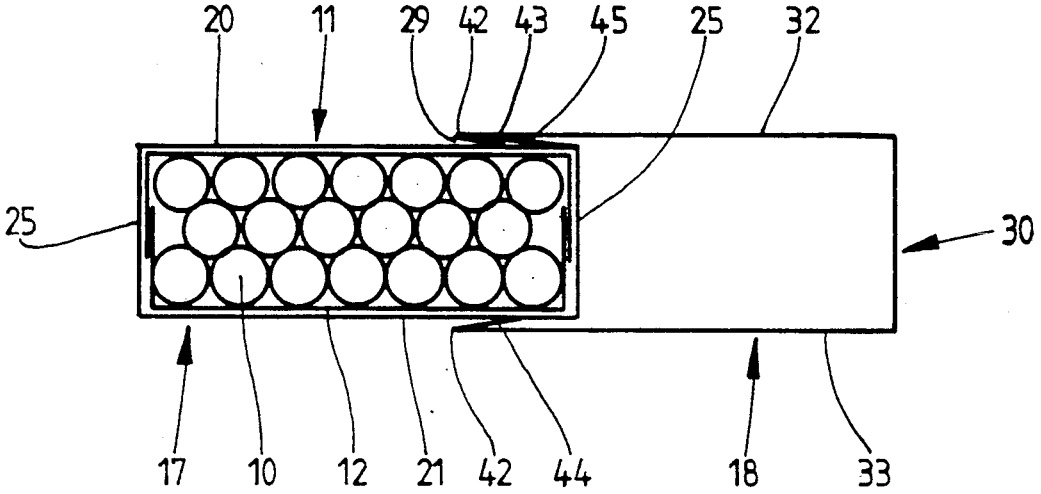

The embodiment of a pack as shown in the drawings serves for holding cigarettes 10. Several cigarettes 10 arranged in rows are grouped together to form a cigarette group 11 which is enwrapped by an inner wrapping 12, generally made of tin foil. The inner wrapping 12 is designed and folded in the customary way, such that the cigarette group 11 is completely enwrapped. In the region of an end face 13, the inner wrapping 12 is folded envelope-like, such that two trapezoidally formed end tabs 14, 15 partially cover one another. The end face 13 of the inner wrapping 12 formed in this way is provided with an opening aid, specifically a cap-like tear-off flap 16 defined by perforation lines 50, 51. When the pack is put into use and opened, this tear-off flap 16 is pulled off, uncovering a portion of the pack contents located at an edge or corner.

Figure 3:
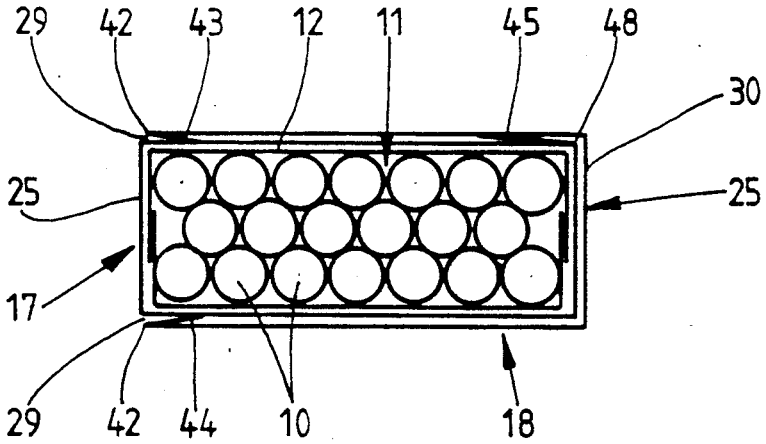

The pack for holding the pack contents (enwrapped cigarette group 11) consists of two independent parts, namely a box part 17 and a casing 18. These pack parts are adapted to one another, such that the box part 17 has the right fit to be received by the casing 18, but in a slideable manner. In closed position (FIG. 3). the box part 17 is practically completely within the casing 18.

The pack contents, namely the cigarette group 11 with inner wrapping 12 is held in the box part 17 which in the present embodiment is designed as a (hard) cup, the end face 13 being completely exposed. The cigarette group 11 with inner wrapping 12 slightly projects from the cup or box part 17. The other faces of the box part 17 are closed.

Accordingly, a box part blank 19 consists of portions being connected to one another to form a front wall 20, an opposed rear wall 21 and a bottom wall 22 arranged thereinbetween. At the longitudinal sides of the rectangular front wall 20 there are arranged (outer) side tabs 23 and at the longitudinal sides of rear wall 21 corresponding (inner) side tabs 24. The side tabs are folded to come to rest on top of one another and are glued together to form box side walls. Bottom corner tabs 26 connected to the side tabs 23 are folded against the inner face of the bottom wall 22.

In the region of an extraction opening which is to be formed by tearing open the inner wrapping 12 at the end face 13, there is an extraction aid in the form of a recess 27, 28 being open towards the upper free edge of the box part 17, that is to say the front wall 20 and the rear wall 21. These recesses 27, 28 being formed in the box part blank 19 by punching facilitate the extraction of cigarettes 10 with two fingers from the opened pack.

The casing 18, which is also made of thin cardboard, nearly s completely surrounds the pack part 17 in the closed position, only sparing out a narrow rectangular push-out opening 29. This push-out opening 29 corresponds in size to an oppositely situated side wall 30 of the casing 18. The cross-section of this push-out opening 29 is adapted to the dimensions of the cross-section of the pack part 17, so that the latter can be pushed out of and back into the casing 18 via this push-out opening 29.

The other two sides or faces of the casing 18 are (mainly) closed. Consequently, the casing 18 is also of a cup-like design and has a laterally directed opening.

Accordingly, a casing blank 31 consists of face portions for forming a front wall 32, an opposed rear wall 33 and a a bottom wall 34 arranged thereinbetween. A covering tab 36 is disposed at the rear wall 33 in order to form an end wall 35. This covering tab 36 is connected to a joining flap 37 which is formed at the upper free edge of front wall 32 by means of adhesive bonding or the like.

Figure 5:
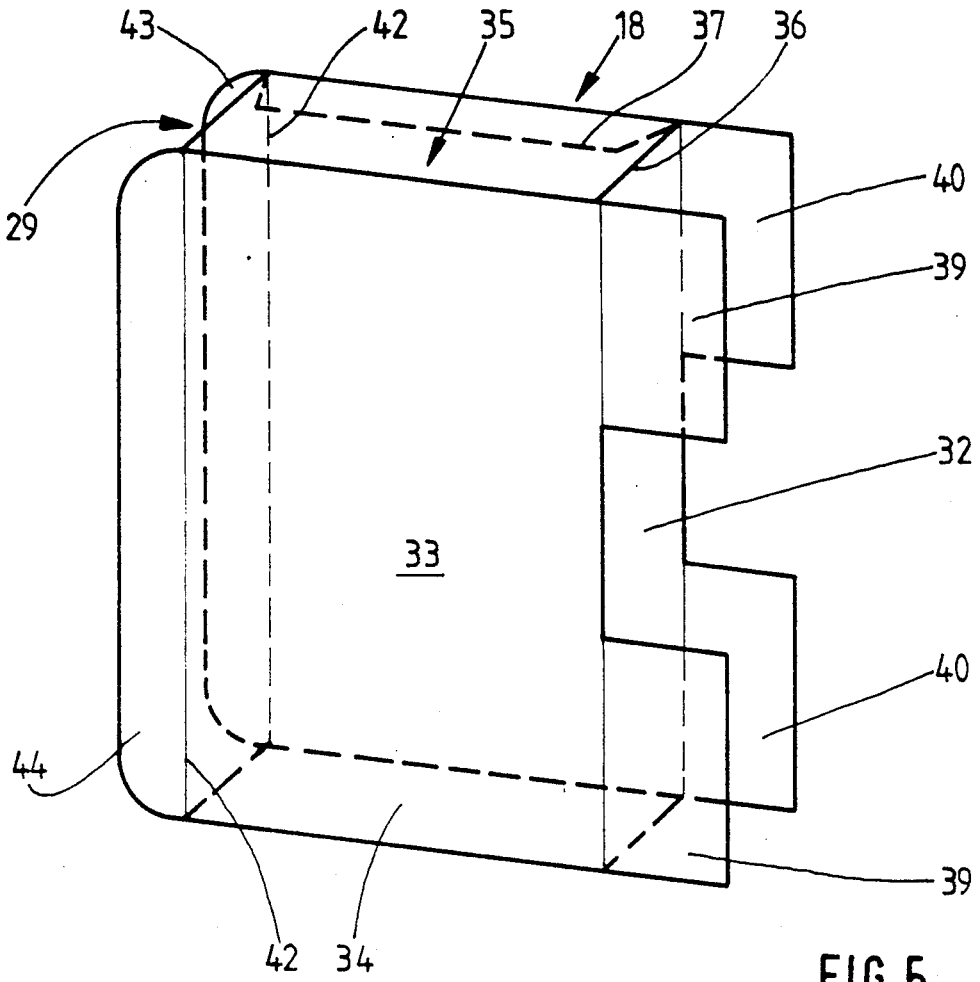

When the afore-specified walls and tabs are folded, a tube-like intermediate folding structure as shown in FIG. 5 is formed. This partially folded embodiment of the casing 18 can be folded down flat, the front wall 32 and the rear wall 33 directly abutting one another in an offset arrangement. To finish the pack, the casing 18 is erected to the position as shown in FIG. 5 and finally folded.

Herewith, the mainly closed side wall 30 is formed by side tabs 39, 40 covering one another, said tabs 39, 40 being arranged at the longitudinal edges of front wall 32 and rear wall 33, respectively. In the present embodiment, the a side tabs 39 and 40 are designed as tab portions with central gaps so that they form a side wall 30 made of two partial side walls 38 spaced apart from one another. Halfway up the side wall there is formed an opening extending across the full width of the side wall 38, namely an actuating opening 41. Said opening 41 makes it possible to apply pressure to the box part 17 in closed position and thus open the pack by pushing the box part 17 out of the casing 18. In the intermediate folding position as shown in FIG. 5, the side tabs 39, 40 are extending in the plane of the front wall 32 and the rear wall 33.

The design of the pack as described above ensures a "single handed operation". The pack is grasped between two fingers. A third finger can move the box part 17 to the open position via the actuating opening 41. Moving the box part 17 back into the initial position within the casing 18 can be done with one hand as well.

Box part 17 and casing 18 are secured against the box part 17 being pushed out completely. For this purpose, the box part 17 comes up to a stop of the casing 18 when being pushed out.

In the present embodiment, an upright outer edge 42 of the casing 18 forms a stop for limiting the push-out opening 29, specifically by means of a stop tab 43 folded over in an acute angle. Said stop tab 43 extends across the full height of the casing 18 as part of the casing blank 31. In the intermediate folding position as shown in FIG. 5, the stop tab 43 extends in the plane of the front wall 32 and thus makes it possible to fold down the casing 18 to a flat-folded position. When the casing 18 is completed in up-folded position, the stop tab 43 is inwardly folded, specifically against the front wall 32. Thus, the stop tab 43 automatically reaches a position forming an acute angle in which its function as a stop can be fulfilled. In the present embodiment, the outer edges 42 are provided with a a stop tab 43, 44 on both sides of the push-out opening 29, so that two stops are formed.

Counter stops are formed on the box part 17 — in the present embodiment there is only one counter stop — which engage the stops (stop tabs 43, 44) of the casing 18. The counter stop in this embodiment is also formed by a folding portion of the box part blank 19. A laterally formed stop flap 45 is folded out of the front wall 20. Said stop flap 45 is formed by a U-shaped punch 46 as a partial face of the front wall 20, approximately centrally halfway up said front wall 20. A folding or pivot axis 47 of the stop flap 45 is formed by perforations which extend in an upright folding edge 48 of the box part 17. This edge 48 is a folding edge extending within the casing 18, i.e. not being pushed out thereof.

Figure 4:
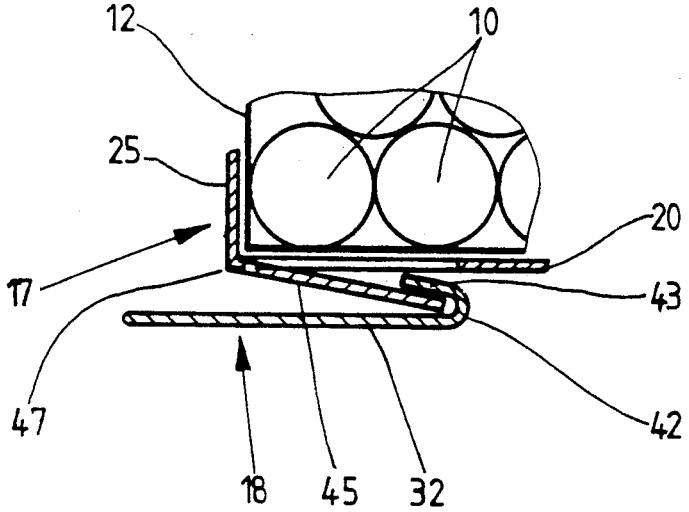
Figure 6:
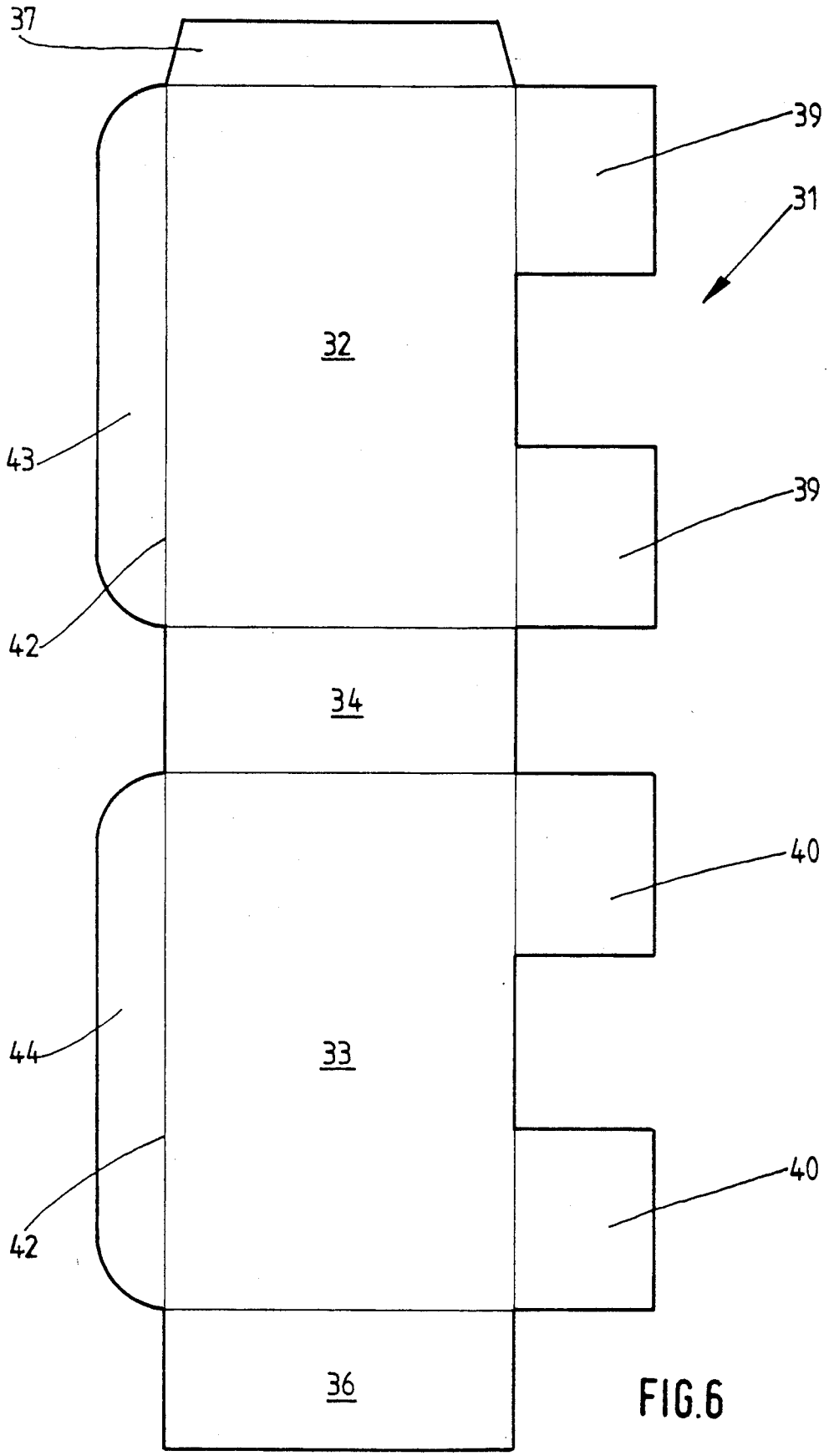
Figure 7:
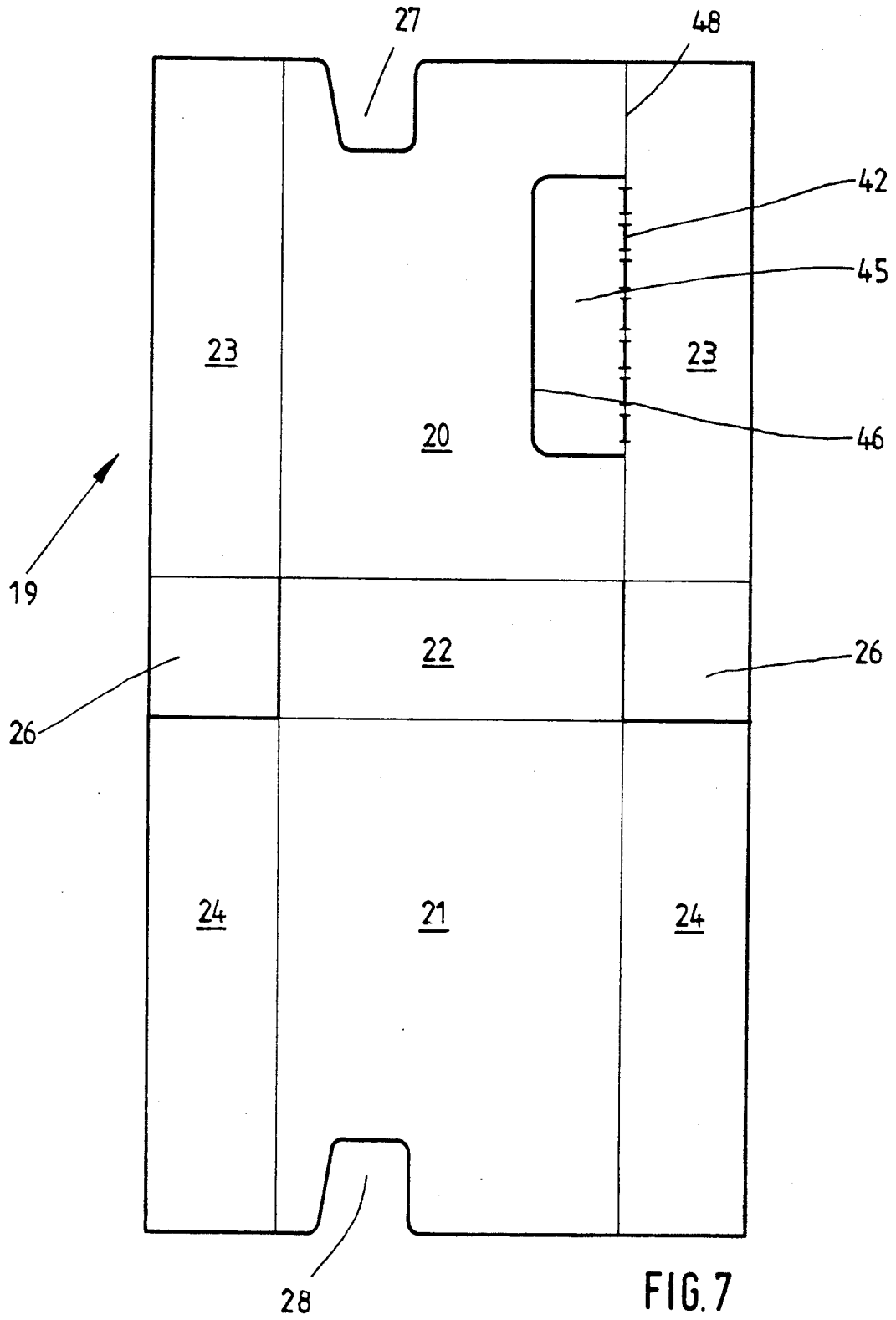

The arrangement of the stop flap 45 as described above has the surprising advantage, that, while the box part 17, i.e. the side tabs 23, is folded, the stop flap 45 automatically moves out of the plane of the front wall 20 into a relative position in an acute angle, as shown in FIG. 4. This is a result of the tension in the material left within the pivot axis 47 of the stop flap 45.

A correspondingly designed stop flap can additionally or alternatively be formed in the region of the rear wall 21.

The stops and counter stops formed by blank portions or folding tabs directed in acute angles have opposing directions, so that when the box part 17 is pushed out of the casing 18, they reliable engage one another in a stable and non-passable way. The stop tab 43 directed towards the inside of the casing 18 receives a free edge of the oppositely directed stop flap 45 of the box part 17 (FIG. 4). The special arrangement of these stop means within the narrow interspace between box part 17 and casing 18 rules out the risk of a deformation in which stop tabs 43 or stop flap 45 would fold over. Stop and counter stop engage one another like barbs.

When the box part 17 is slid back into the casing 18, the stops (stop tab 43 and stop flap 45) release their positive engagement. The respective stops, however, always keep their stop function as a result of the tension in the material and the spatial conditions.

The inner wrapping 12 made of tearable material, especially of tin foil, is designed in a special way, such that it is adapted to the pack part 17 and ensures an easy handling of the pack when it is put into use.

The inner wrapping 12 is provided with an opening aid in the form of the tear-off flap 16 which can be pulled off. Said flap 16 is in the inner wrapping 12 by weakening lines, namely by perforation lines 50, 51. The cap-like tear-off flap 16 formed in this way is located at the top side of the inner wrapping 12, specifically at the side which is free when the pack part 17 is pushed out of the casing 18, in the region of upper pack corners. Furthermore, the tear-open flap 16 is formed in the region of the recesses 27, 28 of the pack part 17, such that the tear-open flap 16 can be easily grasped in a position as shown in FIG. 1 when the pack is put into use.

Figure 8:
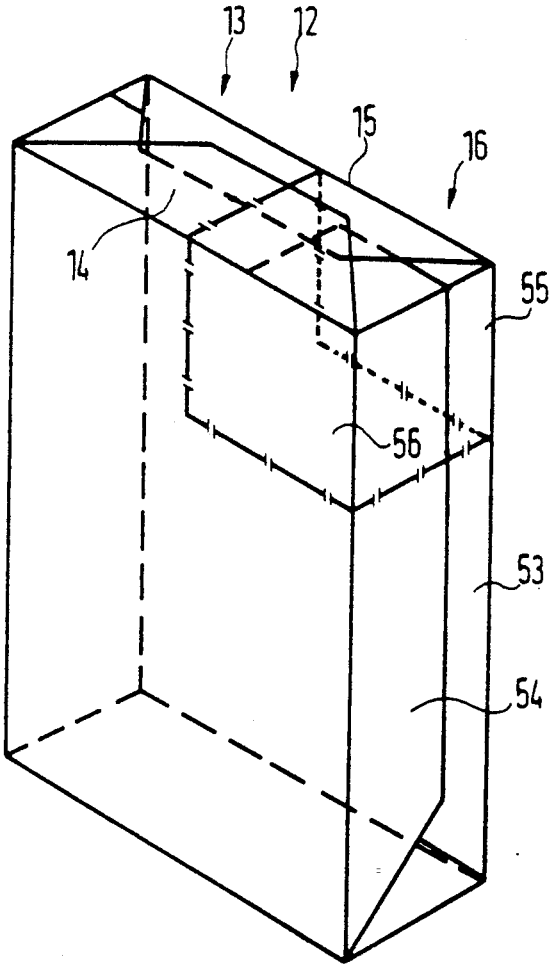

In the present embodiment, the inner wrapping 12 is made of an elongated rectangular blank (FIG. 9) which is folded in a known way over a bottom wall 52, i.e. from below, around the cigarette group 11 in a U-shaped manner. Herewith, side tabs 53, 54 are formed which in the region of a side wall are folded to partially cover one another (FIG. 8). End tabs 14, 15 are also folded in the region of the end face 13 to partially cover one another, specifically in an envelope-like manner.

Figure 9:
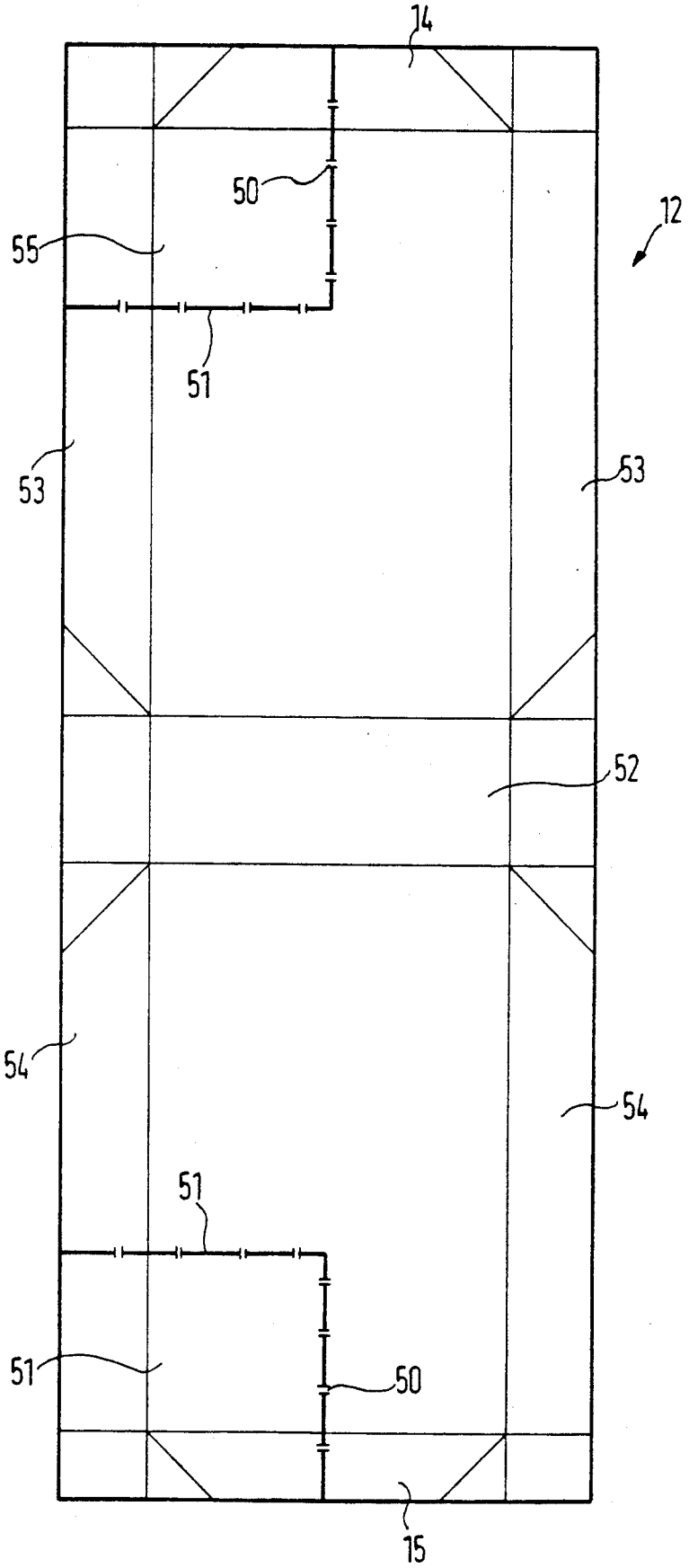

In this (known) embodiment and arrangement of the inner wrapping 12, the cap-like tear-off flap 16 which can be pulled off across a corner portion of the cigarette group 11 is formed out of two partial flaps 55, 56 corresponding to or complementing one another in corner regions of the blank which are located apart from one another (FIG. 9). These partial flaps 55, 56 complement one another when the inner wrapping 12 is formed, such that by pulling off the two partial flaps 55, 56, a corner portion of the pack contents is exposed. Expediently, first the one partial flap 55 and then the other partial flap 56 is pulled off in this process. The partial flaps 55, 56 are each limited in the region of the blank by the two perforation lines 50, 51 extending at right angles and in the present case being of the same length.

I claim:

1. A cuboidal pack made of cardboard, especially for cigarettes, consisting of an inner box part (17) and a cup-like (18) surrounding said box part (17) in closed position, said casing (18) having a push-out opening (29) and a side wall (30) situated opposite thereto, said box part (17) and said casing (18) being slideable relative to one another, characterized in that in an intermediate folding position, the casing (18) is flatly foldable and erectable therefrom to a three-dimensional form from which it can be finally folded:

wherein the side wall (30) consists of two partial side walls (38) which are arranged at a distance from one another and between which an actuating opening (41) is formed; and wherein said partial side walls (38) each consist of two side tabs (39, 40) covering one another and being connected to one another, said side tabs (39, 40) being connected to a front wall (32) and a rear wall (33), respectively, of said casing (18).

2. The pack as claimed in claim 1, wherein in the intermediate folding position, said casing (18) is open on two opposing sides, namely in the region of said push-out opening (29) and in the region of the oppositely situated side wall (30), and wherein after said casing (18) has been erected, side tabs (39, 40) for forming the side wall (30) are foldable into the final position.

3. The pack as claimed in claim 1, wherein, in order to form the flatly foldable casing (18), a covering tab (36) linked to the front wall (32) or the rear wall (33) is connected to a joining flap (37) adjoining the rear wall (33) or the front wall (32) to form an end wall (35) of said casing (18), while the side tabs (39, 40) extend in the plane of the front wall (32) and rear wall (33), respectively.

4. The pack as claimed in claim 1, wherein the cigarettes (10) being arranged in the cup-like box part (17) being open at the top are enwrapped by an inner wrapping (12) which, in the region of upper corners being exposed when the pack is opened has a cap-like tear-off flap (16) defined by weakening lines (50, 51).

5. The pack as claimed in claim 4, wherein said weakening lines (50, 51) extend in the region of a front face, rear face, top face and a side face of the inner wrapping (12) in an exposed corner region thereof.

6. The pack as claimed in claim 4, wherein the inner wrapping (12) is made of a rectangular blank folded in the region of the upper face and side the face, said blank having angular perforation lines (50, 51) on two corner regions located apart from one another.

* * * * *